United States Patent [19]

Pozzebon

[11] Patent Number: 4,620,377

[45] Date of Patent: Nov. 4, 1986

[54] DEVICE FOR ACTUATING A FOOT INSTEP PRESSER PARTICULARLY IN SKI BOOTS

[75] Inventor: Adolfo Pozzebon, Istrana, Italy

[73] Assignee: Nordica S.p.A., Montebelluna, Italy

[21] Appl. No.: 737,020

[22] Filed: May 23, 1985

[30] Foreign Application Priority Data

May 29, 1984 [IT] Italy ..... 21153 A/84

[51] Int. Cl.[4] ..... A43B 5/04

[52] U.S. Cl. ..... 36/119

[58] Field of Search ..... 36/117–121, 36/50

[56] References Cited

U.S. PATENT DOCUMENTS 4,205,467 6/1980 Salomon ..... 36/119
4,523,395 6/1985 Borsoi ..... 36/119

FOREIGN PATENT DOCUMENTS 0073989 3/1983 European Pat. Off. ..... 36/117
2276851 1/1976 France .
WO84/00258 6/1984 PCT Int'l Appl. ..... 36/119

*Primary Examiner*—James Kee Chi
*Attorney, Agent, or Firm*—Guido Modiano; Albert Josif

[57] ABSTRACT

The device for actuating a foot instep presser particularly in ski boots comprises a grip element, within easy reach from a ski boot exterior and operating a linkage placed on the interior of the ski boot. A peculiar aspect of the invention is that the linkage is made to exert pressure at at least two discrete locations spaced apart along the shell longitudinal extension of the ski boot, with a foot presser located inside the boot shell.

4 Claims, 4 Drawing Figures

Fig. 1
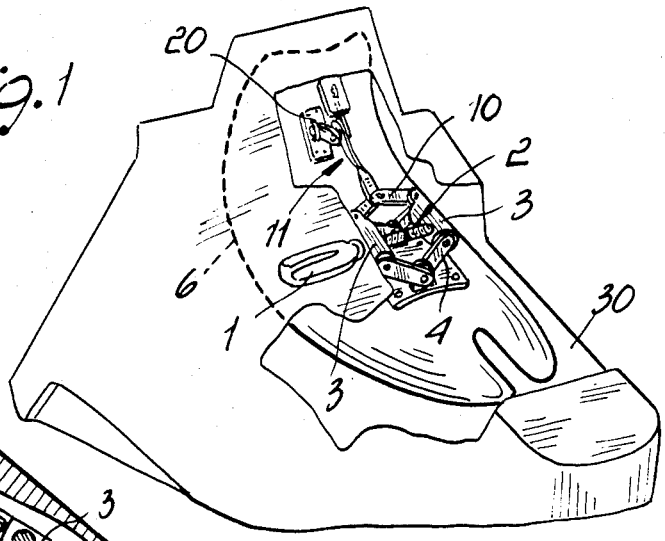
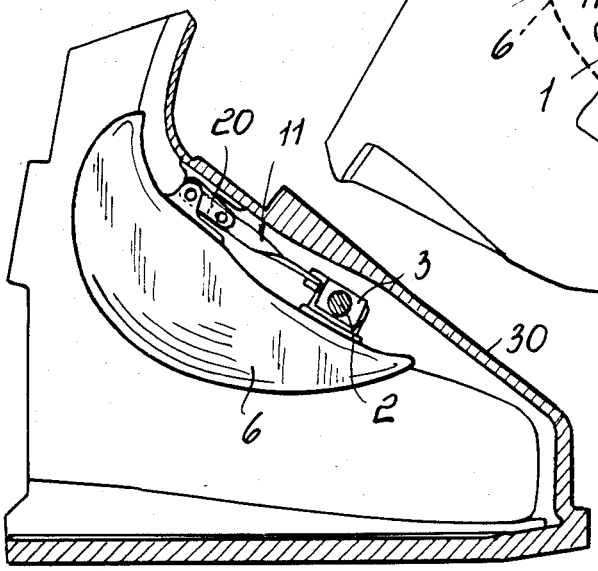
Fig. 3
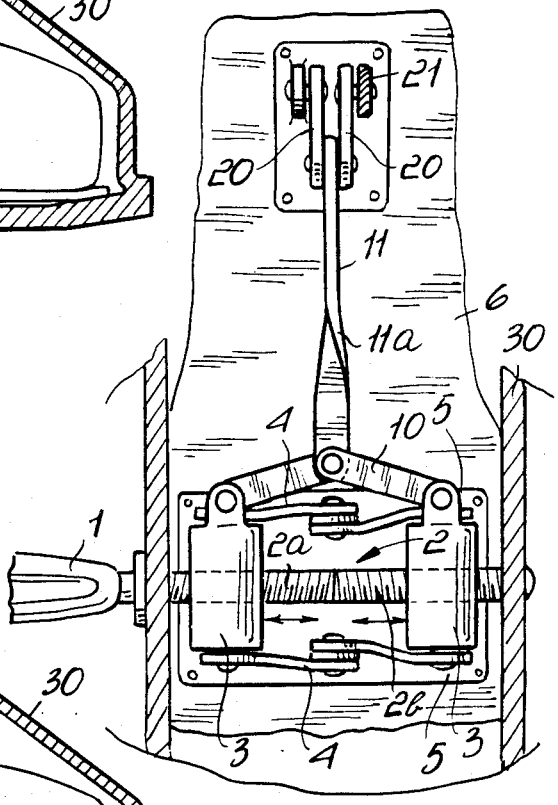
Fig. 2
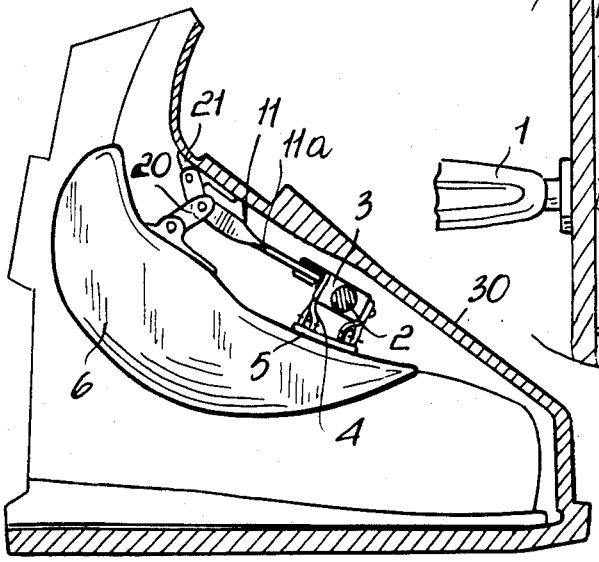
Fig. 4

DEVICE FOR ACTUATING A FOOT INSTEP PRESSER PARTICULARLY IN SKI BOOTS

BACKGROUND OF THE INVENTION

This invention relates to a device for actuating a foot instep presser particularly in ski boots.

As is known, in order to provide improved securement of the foot inside the shell of ski boots, it has been common practice to use pressers comprised of a mainly rigid body shaped to match the shape of the foot instep, which is actuated to apply a desired pressure force to the foot instep so as to secure the foot inside the shell as required.

Such prior devices are so implemented that the pressure force exerted on the presser in order to urge it against the foot instep with a desired force is applied to a single location on the presser, resulting in localized stresses, which besides being inconvenient for the user fail to provide a reliable and stable securement of the presser against the foot instep.

Another disadvantage of the prior approaches is that the displacement of the foot instep presser when actuated to exert its pressure on the foot instep is not accurately controllable throughout its excursion, since actuation at a single location on the presser may result in the presser being undesirably shifted in seeking a set position, which in a sense, alters the distribution of the thrust action on the foot.

SUMMARY OF THE INVENTION

It is the aim of this invention to obviate such prior deficiencies by providing a device for actuating a foot instep presser particularly in ski boots, which enables the foot instep presser to be displaced in a truly guided fashion, thereby the forces brought into play can be distributed and the presser be accurately positioned to exert its pressure force in a correct way.

Within the above aim, it is a particular object of the invention to provide an actuating device which, while providing for a distribution of the forces applied at several locations, can be operated from a single element accessible on the outside of the boot.

Another object of this invention is to provide an actuating device which, while being structurally simple, is not liable to become jammed, and can be readily accommodated within the shell of a ski boot so as to create no objectionable bulkiness.

A not unimportant object of the invention is to provide an actuating device which can be easily formed from elements and materials readily available on the market, and which is competitive from a purely economical standpoint.

The above aim, and these and other objects such as will be apparent hereinafter, are achieved by a device for actuating a foot instep presser particularly in ski boots, according to the invention, comprising a grip element accessible on the exterior of a ski boot and operating kinematic linkage means placed on the interior of said ski boot, characterized in that said kinematic linkage means are arranged to exert pressure at at least two discrete locations spaced apart along the longitudinal extension of a shell of said ski boot, on a foot instep presser located therein.

BRIEF DESCRIPTION OF THE DRAWING

Further features and advantages will become apparent from the following description of a preferred, but not exclusive, embodiment of a device for actuating the foot instep presser particularly in ski boots, with reference to the accompanying illustrative and not limitative drawing, where:

FIG. 1 is a perspective view showing in diagramatic form the actuating device of this invention;

FIG. 2 shows, partly in section, a top plan view of this actuating device; and FIGS. 3 and 4 show, partly in section and in side elevation, two different working positions taken by the actuating device of this invention.

DESCRIPTION OF THE PREFERRED EMBODIMENTS

With reference to the drawing figures, a device for actuating the foot instep presser particularly in ski boots, according to the invention, comprises a grip element composed of a small handle lever 1 which is associated with a rod 2 supported rotatably at its ends on the shell 30 of a ski boot.

The handle lever 1 is accessible from the outside of the boot, and the rod 2, which has first and second portions 2*a* and 2*b* formed with oppositely handed threads, is accommodated inside the boot.

With the threaded portions 2*a* and 2*b* there engage a pair of pawls or nut members 3 formed with a threaded hole wherein the rod 2 engages the pawls 3, which can travel in opposite directions along the threaded rod 2 upon rotation of the latter and are prevented from turning around it, by respective pivotal connection to two pairs of lower connecting rods, indicated at 4, which have their other ends articulated on a plate or base member 5 attached to the foot instep presser 6.

The connecting rods or 4 extend in substantially parallel planes to the rod 2 and perpendicularly to the presser surface.

Also connected to the pawls 3 are two driving connecting rods or link arms 10 which are articulated to each other at their other ends and connected to an intermediate connecting rod 11.

The driving connecting rods 10 are laid in a substantially parallel plane to the presser 6.

The intermediate connecting rod 11 has a twisted portion 11*a* at its middle area, thereby it is presented edgewise to the presser at the other of its ends where it is articulated to the end of a pair of upper connecting rods or levers 20 respectively articulated, with the others of their ends, to the presser 6 at a location apart from the articulation point of the lower connecting rods 4, with respect to the longitudinal direction of the shell, and to a detent indicated at 21 and positioned at the inside surface of the shell.

With the structure just described,on actuation of the handle lever 1 to rotate the rod 2, simultaneously with the translation of the pawls 3 a chain of movements take place which include a displacement of of the lower connecting rods 4 which, where the pawls 3 are moved closer together, is converted into a downward movement of the presser and consequent pressing action on the foot instep, and through the driving connecting rods 10 and intermediate connecting rod 11, into a downward movement of the presser also at a separate location from the point of application of the connecting rods 4, thereby the presser movement becomes guided at two separate locations with respect to the longitudinal direction of the shell.

In this way, the facility is provided of holding securely in position the presser at all times, and of exerting a thrust action which may be optionally adjusted by changing the length ratio of the driving connecting rods so as to apply, to each location on the foot, a desired pressure action through a set movement of the foot instep presser.

In order to release the presser, it will be of course sufficient to turn the rod 2 in the opposite direction, and in so doing, go through the same sequence of movements described above, in the reverse order.

It may be appreciated from the foregoing description that the invention achieves its objects, and in particular that a device is provided which, with a single actuating element comprising the grip element reachable from the boot outside, affords the ability to displace the foot instep presser at two different locations, thus allowing for better control of the securing action by virtue of an improved distribution of loads, while the opportunity is also provided of adjusting the movements of the two locations contingent on requirements.

The invention herein is susceptible to many modifications and variations without departing from the inventive concept.

Furthermore, all of the details may be replaced with other technically equivalent elements.

In practicing the invention, the materials used, as long as compatible with the intended specific use, and the dimensions and shapes may vary according to individual requirements.

I claim:

1. In a ski boot with a longitudinal extension and having a shell portion delimiting an instep zone of the ski boot and in the interior of said ski boot a foot instep presser member below said shell portion, a device for acting onto said foot instep presser member arranged between said shell portion and said presser memeber and comprising, located at a first zone of said presser member a first mechanism expandable upon selected actuation between said shell portion and said presser member to press said presser member in a direction away from said shell portion towards the inside ofthe ski boot and, located at at least another zone of said presser member at a longitudinal distance from said first zone and kinematically linked with said first mechanism at least another mechanism expandable, upon selected actuation of said first mechanism, between said shell portion and said presser member in a direction away from said shell portions towards the inside of the ski boot, thereby to press upon selected actuation of said first mechanism said pressure member towards the inside of the ski boot by exerting a pressure action thereon in at least two zones of said pressure member longitudinally at a distance from each other and actuation means accessible from the outside for selectively actuating said first and said another mechanisms.

2. A device according to claim 1, wherein said first and said another mechanisms are expandable and retractable kinematic linkage mechanisms.

3. A device according to claim 1, wherein said first mechanism comprises an oppositely threaded rod supportingly journalled at both ends thereof on said shell portion and extending trasnverse to the longitudinal direction of said ski boot at a distance above said presser member, said rod having oppositely threaded sections, at least one end of said rod extending at the outside of said ski boot through said shell portion and having a grip thereon for rotating said rod, a first nut member in threaded engagement with one of said oppositely threaded sections and a second nut member in threaded engagement with another of said oppositely threaded sections, thereby to cause said first and said second nut members to approach each other when said rod is rotated in one direction and to move away from each other when said rod is rotated in an opposite direction, at least a first link member hingedly connected to said first nut member for relative rotation with respect to said first nut member about a first axis extending transverse to said rod, at least a second link member hingedly connected to said second nut member for relative rotation with respect to said second nut member about a second axis transverse to said rod and parallel to said first axis and at a distance therefrom, said first and said second link members having each a free end, a base member on said presser member in said first zone thereof, said free ends being hingedly connected to each other and to said base member for relative rotation about a common third axis parallel to said first and said second axis, thereby when said rod is selectively rotated to approach said nut members towards each other said first and said second link members are caused to assume a steepened angular position whereby said base member is pressed towards the ski boot inside while said rod member is maintained supportingly journalled in said shell portion of the ski boot and wherein said second mechanism comprises a connecting rod member extending transverse to said oppositely threaded rod and substantially parallel to said presser member, a pair of link arms hingedly connected to said connecting rod member for relative rotation about a fourth axis of rotation transverse to said oppositely threaded rod and transverse to said first, second and third hinge axis, said pair of link arms having free extremities spaced apart from each other and hingedly connected to said first and second nut member respectivelly for relative rotation about a fifth axis and a sixth axis respectivelly parallel to said fourth axis thereby to shift said connecting rod member in longitudinal direction towards said second presser zone when said oppositely threaded rod is rotated in said one direction, said second mechanism further comprising a second pair of levers hingedly connected to an opposite end of said connecting rod remote from said fourth axis of rotation for relative rotation about a seventh hinge axis parallel to said oppositely threaded rod and at a distance therefrom, one of said levers having a free end thereof hingedly connected to said presser member within said another zone thereof and the other of said levers having another free end thereof hingedly connected to said shell portion, thereby to increase the angle between said levers of said second pair of levers and press at the same time said presser at said another zone thereof when said connecting rod is shifited in longitudinal direction towards said another presser zone upon rotation of said oppositely threaded rod in said one direction.

4. In a ski boot with a longitudinal extension and having a shell portion delimiting an instep zone of the ski boot and in the interior of said ski boot a foot instep presser member below said shell portion, a device for acting onto said foot instep presser member arranged between said shell portion and said presser memeber and comprising, located at a first zone of said presser memeber a first mechanism expandable upon selected actuation between said shell portion and said presser member to press said presser member in a direction away from said shell portion towards the inside of the ski boot and, located at at least another zone of said presser member at a longitudinal distance from said first zone and kinematically linked with said first mechanism at least another mechanism expandable, upon selected actuation of said first mechanism, between said shell portion and said presser member in a direction away from said shell portion towards the inside of the ski boot, thereby to press upon selected actuation of said first mechanism said pressure member towards the inside of the ski boot by exerting a pressure action thereon in at least two zones of said pressure member longitudinally at a distance from each other and actuation means accessible from the outside for selectively actuating said first and said another mechanisms, wherein said first mechanism comprises an oppositely threaded rod supportingly journalled at both ends thereof on said shell portion and extending trasnverse to the longitudinal direction of said ski boot at a distance above said presser member, said rod having oppositely threaded sections, at least one end of said rod extending at the outside of said ski boot through said shell portion and having a grip thereon for rotating said rod, a first nut member in threaded engagement with one of said oppositely threaded sections and a second nut member in threaded engagement with another of said oppositely threaded sections, thereby to cause said first and said second nut members to approach each other when said rod is rotated in one direction and to move away from each other when said rod is rotated in an opposite direction, at least a first link member hingedly connected to said first nut member for relative rotation with respect to said first nut member about a first axis extending transverse to said rod, at least a second link member hingedly connected to said second nut member for relative rotation with respect to said second nut member about a second axis transverse to said rod and parallel to said first axis and at a distance therefrom, said first and sond link members having each a free end, a base member on said presser member in said first zone thereof, said free ends being hingedly connected to each other and to said base member for relative rotation about a common third axis parallel to said first and said second axis, thereby when said rod is selectively rotated to approach said nut members towards each other said first and said second link members are caused to assume a steepened angular position whereby said base member is pressed towards the ski boot inside while said rod member is maintained supportingly journalled in said shell portion of the ski boot and wherein said second mechanism comprises a connecting rod member extending transverse to said oppositely threaded rod and substantially parallel to said presser member, a pair of link arms hingedly connected to said connecting rod member for relative rotation about a fourth axis of rotation trasnverse to said oppositely threaded rod and transverse to said first, second and third hinge axis, said pair of link arms having free extremities spaced apart from each other and hingedly connected to said first and second nut member respectivelly for relative rotation about a fifth axis and a sixth axis respectivelly parallel to said fourth axis thereby to shift said connecting rod member in longitudinal direction towards said second presser zone when said oppositely threaded rod is rotated in said one direction, said second mechanism further comprising a second pair of levers hingedly connected to an opposite end of said connecting rod remote from said fourth axis of rotation for relative rotation about a seventh hinge axis parallel to said oppositely threaded rod and at a distance therefrom, one of said levers having a free end thereof hingedly connected to said presser member within said another zone thereof and the other of said levers having another free end thereof hingedly connected to said shell portion, thereby to increase the angle between said levers of said second pair of levers and press at the same time said presser at said another zone thereof when said connecting rod is shifted in longitudinal direction towards said another presser zone upon rotation of said oppositely threaded rod in said one direction.

* * * * *